US005263204A

United States Patent [19]

Butsch

[11] Patent Number: 5,263,204

[45] Date of Patent: Nov. 23, 1993

[54] JAW PROTECTION DEVICE

[76] Inventor: John L. Butsch, 174 Soldiers Pl., Buffalo, N.Y. 14222

[21] Appl. No.: 976,556

[22] Filed: Nov. 16, 1992

Related U.S. Application Data

[63] Continuation-in-part of Ser. No. 813,264, Dec. 20, 1991, abandoned.

[51] Int. Cl.[5] ..... A42B 1/08

[52] U.S. Cl. ..... 2/424; 2/9

[58] Field of Search ..... 2/9, 410, 422, 424, 2/425

[56] References Cited

U.S. PATENT DOCUMENTS

| | | | |
|---|---|---|---|
| 2,881,442 | 4/1959 | Sowle | 2/9 |
| 3,113,318 | 12/1963 | Marietta | 2/9 |
| 3,167,783 | 2/1965 | Wolfe | 2/9 |
| 3,216,023 | 11/1965 | Morgan | 2/9 |
| 3,478,365 | 11/1969 | Varga | 2/424 |
| 3,886,596 | 6/1975 | Franklin et al. | 2/9 |
| 4,021,858 | 5/1977 | Neeld et al. | 2/9 |
| 4,031,564 | 6/1977 | Wood | 2/9 |
| 4,042,974 | 8/1977 | Morgan et al. | 2/9 |
| 4,677,694 | 7/1987 | Crow | 2/425 |
| 4,885,806 | 12/1989 | Heller | 2/424 |
| 5,093,936 | 3/1992 | Copeland et al. | 2/9 |

*Primary Examiner*—Clifford D. Crowder
*Assistant Examiner*—Michael A. Neas
*Attorney, Agent, or Firm*—Hodgson, Russ, Andrews, Woods & Goodyear

[57] ABSTRACT

A jaw protection device attached or attachable to a helmet to protect a jaw and especially a fractured jaw while it is healing to allow a professional hockey player or the like to continue playing. The device comprises a rigid plate which is rigidly attached to the helmet and which parallels the anatomical structure of the jaw, and the device is spaced from the facial structures so that objects such as hockey sticks and blades are prevented from entering to impact the jaw and so that impact forces are not transmitted from the device to the jaw.

10 Claims, 2 Drawing Sheets

JAW PROTECTION DEVICE

This application is a continuation-in-part of co-pending U.S. patent application Ser. No. 07/813,264, filed Dec. 20, 1991, now abandoned, the disclosure of which is incorporated herein by reference.

The present invention relates generally to head protective gear such as helmets for hockey players. More particularly, the present invention relates to a device attached or attachable to a helmet for protection of a fractured jaw while a professional hockey or other sports player is playing.

Various helmets have been provided for the protection of players. Although conventional helmets provide protection to the head and face, they fail to provide adequate protection to allow a player to play with a fractured jaw while it is healing while also offering adequate visibility and head mobility for effective play.

A helmet having a caged face protector, such as disclosed in U.S. Pat. No. 4,093,936 to Copeland et al. will undesirably allow the entry of foreign objects such as hockey sticks or blades between the cage ribs. It is important to prevent such entry especially while a fractured jaw is healing.

The jaw protector disclosed in U.S. Pat. No. 3,216,023 to Morgan is described as being contoured to approximately correspond to the contour of the jaw. However, FIG. 1 of Morgan shows an unprotected exposed portion of the jaw. This protector is also undesirably constructed to fit snugly against the jaw and is furthermore unstably attached to the helmet at only one point on each side so that it is movable. Such an unstable snugly fitting device may aggravate a fractured jaw and is therefore considered unsuitable for wear while it is healing.

Various other head and face protective gear is disclosed in U.S. Pat. Nos. 2,881,442 to Sowle: 3,113,318 to Marietta; 3,167,783 to Wolfe; 3,478,365 to Varga; 3,886,596 to Franklin et al; 4,021,858 to Neeld et al; 4,031,564 to Wood: 4,042,974 to Morgan et al: 4,677,694 to Crow: 4,885,806 to Heller: 5,148,550 to Hodgkinson et al; and 5,157,794 to Kamata.

A helmet capable of providing adequate jaw protection will not be practical for use if it is heavy and/or has decreased head mobility or obscured lateral or downward vision. For example, the bulky protector of Copeland et al, in addition to not providing suitable jaw protection, may cause obscured downward vision and decreased downward mobility of the head. It is thus considered desirable to provide a device for wear with a helmet to provide a greater degree of jaw protection while being of light weight and providing good head mobility and vision.

It is accordingly an object of the present invention to provide adequate protection to even a fractured jaw while it is healing during play in professional hockey games and the like.

It is another object of the present invention to provide such protection with a device which is of light weight, does not unduly unobscure vision, and which does not restrict head mobility.

In order to achieve such jaw protection, in accordance with the present invention a device is provided which comprises a plate which is rigidly attached to the helmet so that it is fixed immovably to the helmet and which extends along the sides of the jaw and in front of the chin protectively paralleling the anatomical structure of the jaw. The device is spaced from the facial structure so that an impact force on the device is not transmitted to a healing fractured jaw.

The above and other objects, features, and advantages of the present invention will be apparent in the folowing detailed description of the preferred embodiments thereof taken in conjunction with the accompanying drawings wherein the same reference numeral denotes the same or similar parts throughout the several views.

DETAILED DESCRIPTION OF THE PREFERRED EMBODIMENTS

Figure 3:
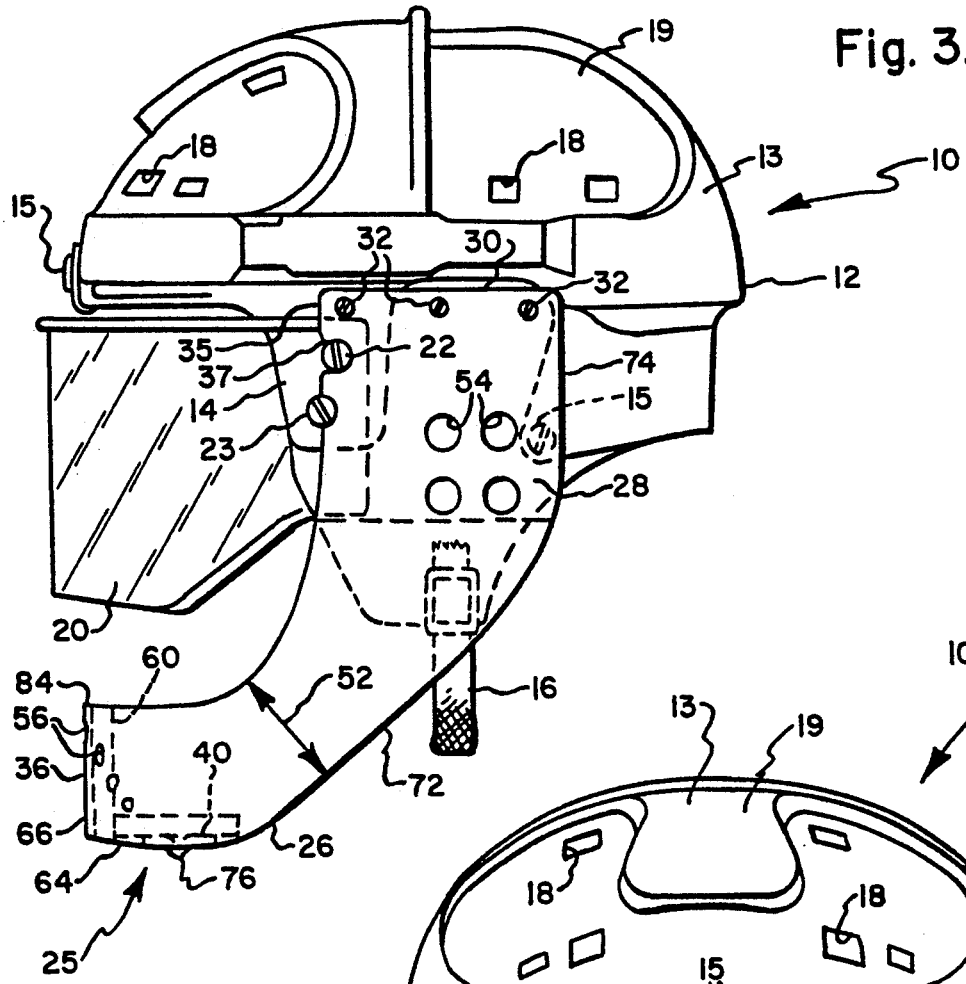
FIG. 3 is a side view thereof shown attached to a helmet.
Figure 4:
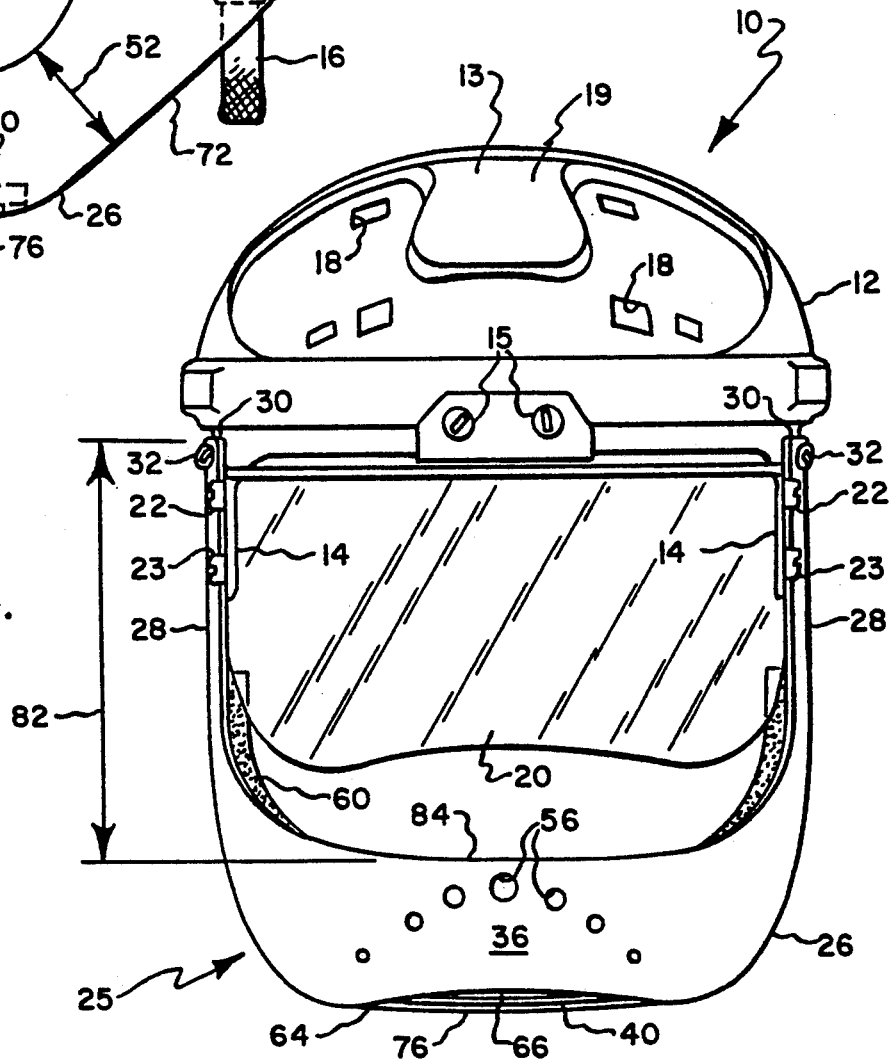
FIG. 4 is a front view thereof shown attached to the helmet.

Referring to the drawings, there is illustrated at 10 in FIGS. 3 and 4 head protective gear which includes a conventional helmet 12 which fits a player's head. The helmet 12 has an outer shell 13 composed of molded plastic or other suitable material and portions 14 of the same material which generally cover the ear areas on each side. A chin strap 16 is attached to the side portions 14. Suitable vent holes 18 are provided in the crown portion 19 of the helmet. The inside of the helmet 12 may be suitably lined by foam rubber cushioning material (not shown) or the like, and a suitable shock-absorbing semi-rigid membrane (not shown) interposed between the lining and the molded plastic. The membrane is suitably secured to the shell 13 by screw fasteners 15 or other suitable means to maintain the membrane flexibly spaced from the shell 13 to provide shock-absorbing capability. The foam rubber may be suitably adhesively attached to the membrane. A see-through visor 20, such as, for example, a ITECH eye shield, marketed by ITECH of Montreal, Canada, extends across the front of the helmet 12 for protection of the eyes while allowing good visibility. The visor 20 is securely attached on each side to the respective side portion 14 by a pair of screws 22 and 23 which are received in apertures in the visor and threaded apertures (not shown) in the helmet, the lower screw 23 in the illustrated embodiment being offset slightly forwardly from the upper screw 22. Such a helmet is well known in the art and worn, for example, by professional hockey players, and will therefore not be described in further detail herein. For example, the helmet may be of a type marketed by Canadian Cycle and Motor of Toronto, Canada. For another example, the helmet may be a Cooper helmet, Model No. SK 2000 L.

In order to provide protection to the jaw, even a fractured jaw during healing, while allowing the mobility, good lateral vision, and light weight needed by professional hockey players and the like, in accordance with the present invention there is provided a jaw protection device, illustrated at 25, comprising a rigid elongate curved plate 26 which has a pair of substantially parallel side or end portions 28 which are attached adjacent their end edges 30 respectively to helmet portions 14 by suitable means such as screws 32 received in plate apertures 33 and shell apertures (not shown) and secured by nuts (not shown), the front edge 35 of each side portion 28 being received between the respective edge portion of the visor 20 and the shell 13.

It is important that the rigid plate 26 be rigidly attached to the helmet 12 so that it is fixed immovably thereto so as to prevent its possible contact with a fractured jaw in the event of a heavy blow on the plate 26. Thus, three of the apertures 33 are provided along each top or end edge 30, and the plate 26 is further held immovable by the front edge 35 of each end portion 28 being positioned to abut helmet screws 22 and 23. The front edge 35 has an indent, illustrated at 37, of perhaps about ½ inch, which receives helmet screw 22 to permit vertical orientation of the end portions 28 in view of the forward offset of helmet screw 23 of the particular Cooper helmet depicted. However, it should be understood that the plate 26 may be rigidly secured to this helmet by other suitable means or to other types of helmets by other suitable means which are appropriate therefor. The plate 26 may be worn with a helmet with or without the visor or with a visor having a different suitable size or shape, as may be desired.

Figure 1:
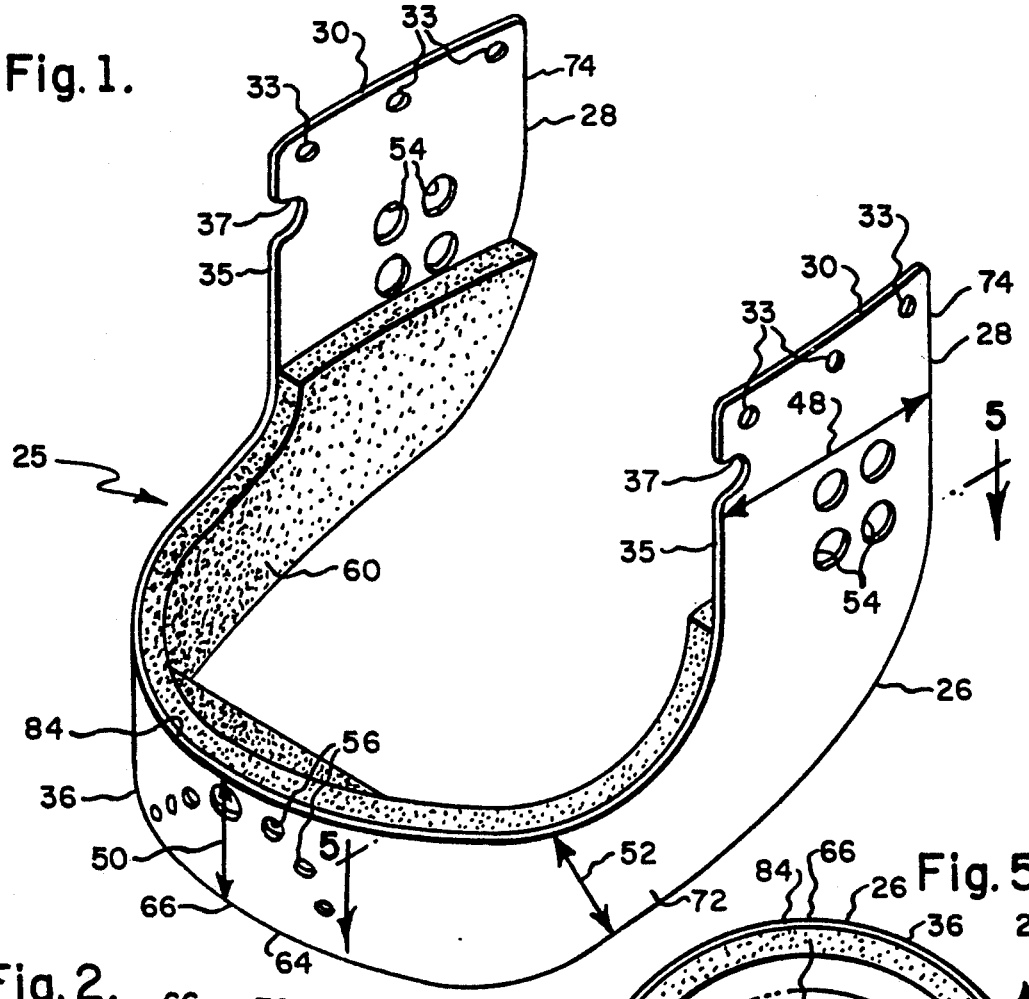
FIG. 1 is a perspective view of a device which embodies the present invention.

The plate 26 also includes a curved intermediate portion 36 which extends between the end portions 28. It is important that the plate 26 not have openings or the like which might allow penetration of foreign objects such as hockey sticks or blades to contact the jaw as it is healing. In order to guard against such penetration, the plate 26 must be of a sufficient width to guard the jaw and be constructed to be free of large openings which would allow such penetration, unlike the large openings in the ribbed cage of the Copeland et al patent. However, some smaller openings, as hereinafter described, may be provided. Thus, by "plate", as used herein and in the claims, is meant a member which has a width sufficient to cover or guard the jaw, as discussed in greater detail hereinafter, and which is free of openings of a size which would allow penetration of objects normally encountered during play of a sport to impact the jaw. As shown in FIG. 1, the intermediate portion width, illustrated at 50, is less than the end portion width, illustrated at 48. The width, illustrated at 52, at the intersection of the intermediate and end portions, discussed in greater detail hereinafter, may be less than the intermediate portion width 50. As the plate width is increased, the protection afforded to the jaw is accordingly increased. However, as the intermediate portion width 50 is increased, visibility and head movement, which are important during playing of professional hockey or other sports, become more obstructed. Thus, it is important to size the plate 26 for sufficient jaw protection while minimizing the effect on vision and head movement. For the plate 26 to afford sufficient jaw protection, it is considered that it should have a minimum width of about 1½ inches. In order not to unduly impair vision or obstruct head movement or breathing, it is considered that the width 50 of the intermediate portion should not exceed about 2½ inches. The intermediate portion preferably as a width 50 which is about 2¼ inches and the width 52 is preferably about 1¾ inches for protection of a fractured jaw. For prophylactic protection of a non-fractured jaw or for protection of a fractured jaw wherein the major portion of healing time is completed, it is preferred that width 50 be reduced to perhaps about 1¾ inches with width 52 still being about 1¾ inches. In either case, the width 48 of each of the end portions is preferably about 3½ inches to afford adequate width for rigid attachment as well as maximum jaw protection.

The plate 26 is preferably a single piece of generally uniform thickness throughout. In order to minimize its weight, it is preferred that it be composed of a rigid aluminum alloy material having a thickness of between about 1/32 and 1/16 inch, for example 18 gage, or other suitable light-weight material, such as, for example, a thin light weight durable plastic, having a suitable thickness providing the desired rigidity while having minimum weight. For example, the plate 26 composed of an aluminum alloy may suitably have a weight of perhaps 6 ounces.

The jaw of a person is generally a U-shaped bone structure having a curved intermediate portion, known as the mandible, which defines the chin and a pair of portions on either side, known as the ramus, extending vertically from the mandible to connect to the base of the skull at the front of and adjacent the ears. In order to protect the jaw, in accordance with the present invention the plate 26 is shaped to extend along both sides of the jaw and in front of the chin paralleling the anatomical structure of the jaw.

Figure 5:
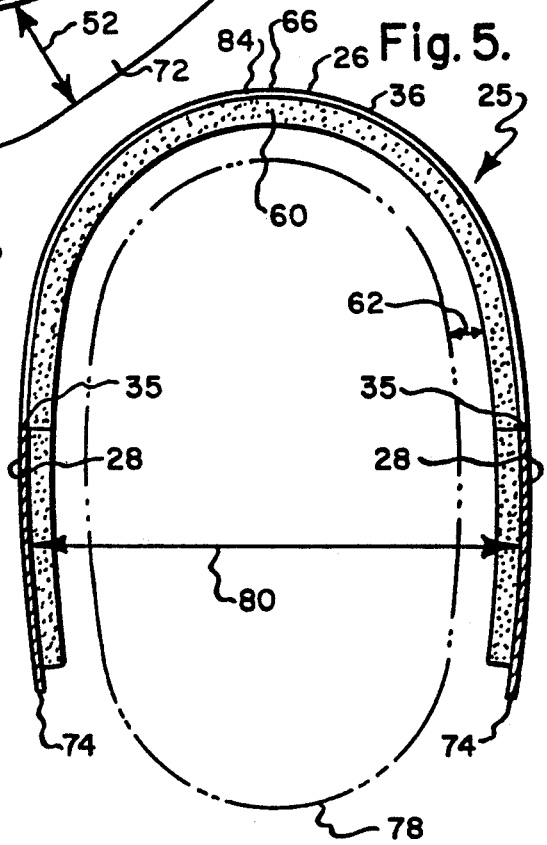
FIG. 5 is a sectional view thereof taken along lines 5—5 of FIG. 1 and illustrating its spacing from the head of a person wearing a helmet having the device.

The device 25 may be provided with padding, illustrated at 60, of a suitable foam material, which may be the same as the helmet padding material, having a thickness of perhaps about ¼ inch suitably adhesively attached to the inner surface thereof. It is important that the device 25 not transmit forces impacting thereon to a fractured jaw. In order to prevent such transmission of impact forces, in accordance with the present invention the rigidly attached device 25 is adapted to be spaced from the facial structures of the person wearing the helmet. The device 25 may generally be so spaced from the face, illustrated at 78, that a pair of fingers can be inserted between the padding 60 and the face, i.e., a spacing, illustrated at 62 in FIG. 5, of preferably between about ¾ and 1½ inches such as, for example, about 1½ inches. In accordance with such spacing, the side portions 28, which are substantially parallel to each other, may be spaced apart a distance, illustrated at 80, of between about 7 and 8 inches such as, for example, 7½ inches. The distance, illustrated at 82, between the end or upper edges 30 and the upper edge 84 of the intermediate portion 36 is equal to perhaps between about 5¼ and 5½ inches.

Figure 2:
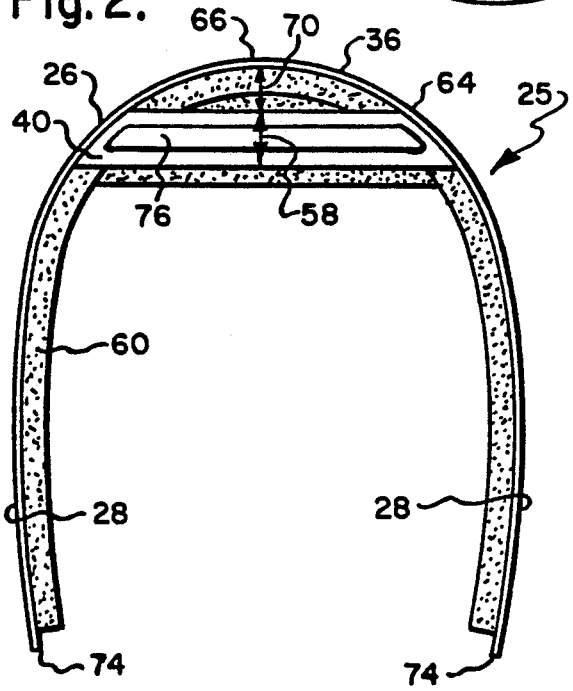
FIG. 2 is a bottom view thereof.

Referring to FIG. 2, a rigid elongate member 40 in the form of a plate is preferably attached to both sides of the frontal or intermediate portion 36 at the lower edge 64 thereof to extend across the plate 26 rearwardly of the forward most portion 66 thereof in generally the plane of the lower edge 64 of the intermediate portion 36 so that it is disposed below and spaced from the chin for protection thereof from a striking force from underneath. Plate 40 may be welded to or integral with plate 26 or otherwise suitably attached thereto.

The plate 40 may be composed of a similar material as that of which plate 26 is composed, has a width, illustrated at 58, up to about 1 inch such as, for example, about ¾ inch, and is spaced, as illustrated at 70, from the forward most point of intermediate portion 36 a distance equal to perhaps about ¾ inch. If desired, the plate 40 can be shaped to fill in the space forwardly between it and the lower edge 64. However, as shown in FIG. 2, this space, which allows the plate 40 to be lighter, is blocked by the padding 60 to prevent entry of objects so that the filling in of this space may be unnecessary. The member 40 is shown to have a corrugation, illustrated at 76, for increased rigidity. The member 40 may be embodied otherwise, such as a bar, or it may have suitable openings to lighten it.

The front edges 35 of the side portions 28 are disposed sufficiently rearwardly, such as adjacent the front of the helmet ear portions 14, so as to obstruct side or peripheral vision as little as possible while still adequately guarding the jaw.

As best seen in FIG. 3, the corners 72 of the plate 26 defining the intersection of rear edges 74 of the side portions 28 with the respective lower edges 64 of the front portion 36 are chamfered to prevent interference between the wearer's shoulders and the plate 26 during sideways head movement while the plate 26 still parallels the jaw for protection thereof. Thus, as previously discussed, the width 52 at the chamfered corner 72 is preferably equal approximately to or slightly less than the intermediate portion width 50.

A plurality of perhaps four apertures 54 are provided generally centrally of each of the side portions 28 to allow easier hearing as well as lightening the plate 26. These apertures 54 overlie sound-transmitting openings in the helmet side portions 14. As shown in FIG. 1, the foam padding 60 terminates short of these apertures 54 and at a distance from end edge 30 equal to perhaps about 3½ inches. Apertures 54 may have a diameter of perhaps ⅝ or ¾ inch, the upper aperture being spaced perhaps about 2 inches from edge 30. The apertures 54 may be spaced from adjacent apertures a distance of perhaps about ¼ inch.

A plurality of perhaps seven apertures 56 are provided midway of the front portion 36, with corresponding apertures in the padding 60, for air as well as lightening the plate 26. These apertures 56 may have diameters up to perhaps about ¼ inch so that they are not so large as to allow the passage of objects which might normally be encountered to contact the jaw.

The apertures 54 and 56 may be otherwise suitably positioned or other similarly small apertures may be provided in the plate for air-flow, sound-transmission, or another suitable purpose.

The device 25 may, if desired, be formed integrally with the helmet 12 or, as shown, fitted to existing helmets. While developed for protection of fractured jaws during play of a professional sport or the like, it should be understood that device 25 may also be provided for use prophylactically for protection of the jaw.

A jaw protection device as described herein has been worn sucessfully by a professional hockey player during play in professional hockey games while his fractured jaw was healing.

It is to be understood that the invention can be embodied otherwise without departing from the principles thereof. For example, the device may have other dimensions than described herein as long as the device does not depart from the principles of the present invention. Such other embodiments are meant to come within the scope of the present invention as defined by the appended claims.

I claim:

1. A device for attachment to a helmet for protecting a jaw comprising a rigid elongate plate having a pair of substantially parallel end portions and a curved intermediate portion extending between said end portions, means for rigidly attaching said end portions to a helmet on sides thereof respectively so that said plate is fixed immovably to the helmet, said intermediate portion being disposed to extend in front of and spaced from the chin and curved to follow the contour of the chin, said end portions being disposed to be spaced from the facial structures of the person and to overlie the jaw on the respective sides of the face of the person whereby said plate is shaped to extend along both sides of the jaw and in front of the chin paralleling the anatomical structure of the jaw, the device being adapted to be spaced from the facial structures of the person wearing the helmet, said intermediate portion having generally parallel upper and lower curved edges which are generally horizontally disposed when the helmet is worn by the person, each of said end portions having generally parallel forward and rear edges which are generally vertically disposed when the helmet is worn by the person, said upper edge connecting to said forward edge, said plate having an edge extending between each of said rear edges and said respective lower edge at an oblique angle relative thereto to provide a chamfered corner to said plate so that interference between the device and the shoulders of the person is reduced during sideways head movement, and wherein said plate has a width along said chamfered edge which is less than about a width of said intermediate portion and less than about a width of each of said end portions.

2. A device according to claim 1 wherein said plate has a lower edge and the device further comprises a rigid elongate member having a pair of end portions each of which is attached to said lower edge on opposite sides respectively of the device to be spaced from and underlie the chin to prevent objects from entering to contact the jaw from underneath the jaw.

3. A device according to claim 1 wherein said intermediate portion has a width which is between about 1½ and 2½ inches.

4. A device according to claim 1 wherein the device is adapted to be spaced between about ¾ and 1½ inches from the facial structures of the person wearing the helmet.

5. A device according to claim 1 wherein an inner surface of said intermediate portion is lined with a cushion material.

6. A helmet comprising a shell sized to receive the head of an individual and including a pair of side portions, a jaw protection device comprising a rigid elongate plate having a pair of substantially parallel end portions and a curved intermediate portion extending between said end portions, means for rigidly attaching said end portions to said helmet side portions respectively so that said plate is fixed immovably to the helmet, said intermediate portion being disposed to extend in front of and spaced from the chin of the individual and curbed to follow the contour of the chin, said end portions being disposed to follow the contour of the jaw on the respective sides of the face of the individual and to be spaced from the facial structures of the individual whereby said plate is shaped to extend along the jaw on both sides of the face and in front of the chin paralleling the contour of the anatomical structure of the jaw, said device being adapted to be spaced from the facial structures, said intermediate portion having generally parallel upper and lower curved edges which are generally horizontally disposed when the helmet is worn by the person, each of said end portions having generally parallel forward and rear edges which are generally vertically disposed when the helmet is worn by the person, said upper edge connecting to said forward edge, said plate having an edge extending between each of said rear edges and said respective lower edge at an oblique angle relative thereto to provide a chamfered corner to said plate so that interference between the device and the shoulders of the person is reduced during sideways head movement, and wherein said plate has a width along said chamfered edge which is less than about a width of said intermediate portion and less than about a width of each of said end portions.

7. A helmet according to claim 6 wherein said plate has a lower edge and the device further comprises a rigid elongate member having a pair of end portions each of which is attached to said lower edge on opposite sides respectively of the device to be spaced from and underlie the chin to prevent objects from entering to contact the jaw from underneath the jaw.

8. A helmet according to claim 6 wherein said intermediate portion has a width which is between about 1½ and 2½ inches.

9. A helmet according to claim 6 wherein the device is adapted to be spaced between about ¾ and 1½ inches from the facial structures of the person wearing the helmet.

10. A device for attachment to a helmet for protecting a jaw comprising a rigid elongate plate having a pair of substantially parallel end portions and a curved intermediate portion extending between said end portions, means for rigidly attaching said end portions to the helmet on sides thereof respectively so that said plate is fixed immovably to the helmet, said intermediate portion having a width which is between about 1½ and 2½ inches and being disposed to extend in front of and spaced from the chin of a person wearing the helmet and curved to follow the contour of the chin, said end portions being disposed to be spaced from the facial structures of the person and to overlie the jaw on the respective sides of the face of the person whereby said plate is shaped to extend along both sides of the jaw and in front of the chin paralleling the anatomical structure of the jaw, the device being adapted to be spaced between about ¾ 1½ inches from the facial structures of the person wearing the helmet, said intermediate portion having a lower edge, the device further comprising a rigid elongate member having a pair of end portions each of which is attached to said lower edge on opposite sides respectively of the device to be spaced from and underlie the chin to prevent objects from entering to contact the jaw from underneath the jaw, said intermediate portion having generally parallel upper and lower curved edges which are generally horizontally disposed when the helmet is worn by the person, each of said end portions having generally parallel forward and rear edges which are generally vertically disposed when the helmet is worn by the person, said upper edge connecting to said forward edge, said plate having an edge extending between each of said rear edges and said respective lower edge at an oblique angle relative thereto to provide a chamfered corner to said plate so that interference between the device and the shoulders of the person is reduced during sideways head movement, and wherein said plate has a width along said chamfered edge which is less than about a width of said intermediate portion and less than about a width of each of said end portions.

* * * * *